United States Patent [19]

Gibson et al.

[11] 4,342,180

[45] Aug. 3, 1982

[54] ASSEMBLY METHOD OF CONSTRUCTING A BUILDING

[75] Inventors: Adler E. Gibson, Tulsa; Paul H. Kellert, Mannford, both of Okla.

[73] Assignee: Gibco International Corporation, Tulsa, Okla.

[21] Appl. No.: 120,506

[22] Filed: Feb. 11, 1980

[51] Int. Cl.[3] ..... E04B 1/00

[52] U.S. Cl. ..... 52/741; 52/91; 52/309.12; 52/424

[58] Field of Search ..... 52/741, 91, 309.12, 52/405, 383, 424

[56] References Cited

U.S. PATENT DOCUMENTS

| | | | |
|---|---|---|---|
| 1,963,980 | 6/1934 | Garrett | 52/383 X |
| 3,324,611 | 6/1967 | Gamber | 52/91 |
| 3,559,355 | 2/1971 | Day, Jr. | 52/383 X |
| 3,659,388 | 5/1972 | Sirianni | 52/91 |
| 3,676,973 | 7/1972 | Kellert | 52/262 |
| 4,125,981 | 11/1978 | MacLeod et al. | 52/741 X |
| 4,161,852 | 7/1979 | Schultz | 52/741 X |

*Primary Examiner*—Carl D. Friedman
*Attorney, Agent, or Firm*—William S. Dorman

[57] ABSTRACT

A method of constructing a building having load-bearing and insulation properties comprising the steps of erecting a loose frame by first arranging a plurality of horizontally disposed lower steel channels in the form of a closed polygon on a base support, the channels having their ends welded together to form the lower corners of the frame. A plurality of vertical steel supporting posts are mounted on the lower corners and have their lower ends welded to the channels. A plurality of horizontally disposed upper steel beams are arranged in the form of a matching polygon above the channels, the beams having their ends welded together to form the upper corners of the frame. The beams are supported at the upper corners by welding the upper ends of the posts to the beams so as to dispose each upper corner above a lower corner whereby the upper polygon has a matching parallel relation to the lower polygon. A first plurality of horizontally spaced vertical steel rods is welded to the exterior side of the beams and channels. A layer of plastic insulation material is disposed between the beams and the channels. A second plurality of horizontally spaced vertical steel rods is welded to the interior side of the beams and channels so as to sandwich the layer of insulation between the first and second plurality of vertical rods. A first and a second plurality of vertically spaced horizontal steel bars are tied to the vertical rods at their points of intersection. Exterior and interior layers of wire mesh are overlaid on the horizontal bars and tied to the bars, thus completing the loose frame. A bracing is arranged at one of the posts so as to dispose the same in a plumb or true vertical position. A layer of concrete is applied to both sides of the frame and a sufficient time lapse is allowed for the concrete to set so as to provide the building with an initial rigidity after which the bracing can be removed.

4 Claims, 6 Drawing Figures

ASSEMBLY METHOD OF CONSTRUCTING A BUILDING

BACKGROUND OF THE INVENTION

1. Field of the Invention

The present invention relates to a building construction method, more particularly an assembly method having the load-bearing characteristics of concrete that also incorporate insulation properties not inherent in typical concrete construction.

2. Prior Art

Building construction methods employing the load-bearing characteristics of concrete are well known in the prior art. However, building construction which is exclusively concrete has little or no insulation properties. In the past, methods which incorporate interior insulation with concrete are either slow and difficult to construct or require modular wall sections and materials which have been specially adapted for a particular construction method. Our prior art patent, U.S. Pat. No. 3,676,973 to Kellert, is similar to the present invention; however, there are substantial differences to be disclosed hereafter. None of the prior art discloses an assembly-type method which uses stock materials that are readily available.

SUMMARY OF THE INVENTION

An object of the present invention is to provide a low cost, on-site construction method based on an assembly process of interiorly insulated reinforced concrete walls. Another object of the present invention is to provide a construction method that can be performed by semi-skilled or unskilled labor in a minimum amount of time. A further object of this invention is to provide a method which uses stock materials which are readily available.

The construction method of the prsent invention assembles a building, such as a house with a conventional slanted roof, having a loose frame skeleton with a layer of interior insulation and layers of concrete on the interior and exterior surfaces of the roof and walls to provide strength and rigidity.

The loose frame comprises horizontally disposed lower steel channels arranged in the shape of a closed polygon and loosely anchored to a pre-set slab or floor. The end of the channels are mitered and tack-welded together, thus forming the lower corners of the frame. At the lower corners, vertical steel posts are tack-welded at their lower ends to the channels. The upper ends of the posts are tack-welded at the upper corners to horizontally disposed upper steel beams. The upper corners are formed by the mitered and welded ends of the beams and are vertically disposed directly above the lower corners so that the upper beams are in the shape of matching closed polygon.

A first plurality of round vertical steel rods are tack-welded to the exterior sides of the beams and the channels, and are horizontally spaced 24" apart. In the example of the present invention, the upper ends of the exterior rods extend beyond the beams on the two sides perpendicular to the apex line of a slanted roof. A layer of pressed insulation, preferably 2'×8' sheets of plastic insulation material such as polyurethane or styrofoam, is disposed between the beams and channels. The insulation layer is loosely secured by a second plurality of vertical rods tack-welded to the interior of the beams and channels on the same 24" spacing as the first plurality.

A first and second plurality of horizontally disposed steel bars are vertically spaced 24" apart on both the interior and exterior sides of the frame. The bars are secured to the frame at their points of intersection with the first and second plurality of rods by tie wires. The tie-wires extend through the insulation and serve to pull the bars tight against the insulation. Wire mesh is overlaid on the first and second plurality of bars and secured to the bars by tying. The wire mesh can be of a type having open rectangular areas 2"×2" or smaller.

The roof construction is similar to the frame construction. A plurality of steel brackets are tack-welded to the top of the steel beams and serve as an initial support for a plurality of roof trusses. The brackets are arranged 24" apart on two opposed sides of the building which run parallel to the apex line of a slanted roof. The roof trusses comprise a plurality of rods welded to the upper portions of the brackets which serve as top chords, a plurality of horizontally disposed rods welded to the lower portions of the brackets which serve as bottom chords, and various web members of different lengths and inclinations welded to the top chords and the bottom chords. The top chords extend at an upwardly sloped angle from the brackets having their ends joined to a bar forming the apex line of the roof.

Along the ends of the roof perpendicular to the apex line, a plurality of roof channels are arranged in the same inclined planes as the top chords are secured to the frame by tack-welding their lower ends to the top of the beams and tack-welding their mitered upper ends to each other. The extending upper ends of the exterior vertical rods are tack-welded to the outer edges of the top chords along the sides perpendicular to the apex line.

A first plurality of horizontally disposed roof bars are tack-welded to the interior of the roof channels. A layer of insulation is supported on the first plurality of roof bars and a second plurality of horizontally disposed roof bars are tack-welded to the exterior of the roof channels. The roof bars are pulled tightly against the insulation by tie wires positioned at the points of intersection between the bars and the top chords.

A layer of insulation is disposed between the upper beams and the apex line along the sides perpendicular to the apex line. The insulation material is cut to fit the triangular areas and is secured to the roof frame by tie wires. A layer of wire mesh is now overlaid on exterior of the four sides of the roof and is tied to the second plurality of roof bars and the extending upper ends of the exterior vertical rods.

At this point, the two frames of the entire building are complete and ready for a first coat of concrete to be applied to the exterior and interior of the building. One of the vertical posts is braced to a plumb position and concrete is applied to the frame either by gunning or by hand. The first coat is allowed to set for two hours and then the corner bracing can be removed. Afterward, a second coat can be applied and subsequent layers of concrete may be applied allowing sufficient time for each coat to set. The concrete should reach a minimum strength of 4000 pounds p.s.i. in 28 days.

DETAILED DESCRIPTION OF THE PREFERRED EMBODIMENTS

The present invention relates to a building construction method, more particularly an assembly construction method having the load-bearing characteristics of concrete and insulation properties not inherent in concrete construction alone.

Figure 1:
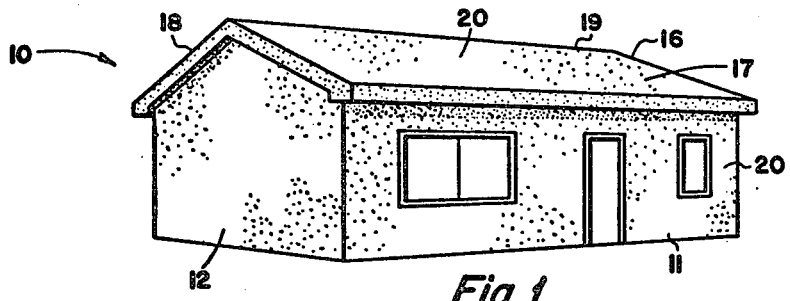
FIG. 1 is a perspective view of a building constructed in accordance with the loose frame type of construction of the present invention.

Referring to FIG. 1, a building 10 is rectangular in shape having four vertical walls or sides 11, 12, 13 and 14. However, only walls 11 and 12 are shown in this figure. Building 10 is also comprised of a roof 16 having two sloped sides 17 and 18 and an apex line 19. Vertical walls 12 and 14 are perpendicular to apex line 19, whereas vertical walls 11 and 13 run parallel to apex line 19. Walls 11, 12, 13 and 14 and roof 16 are provided with exterior and interior surfaces of concrete 20.

Figure 2:
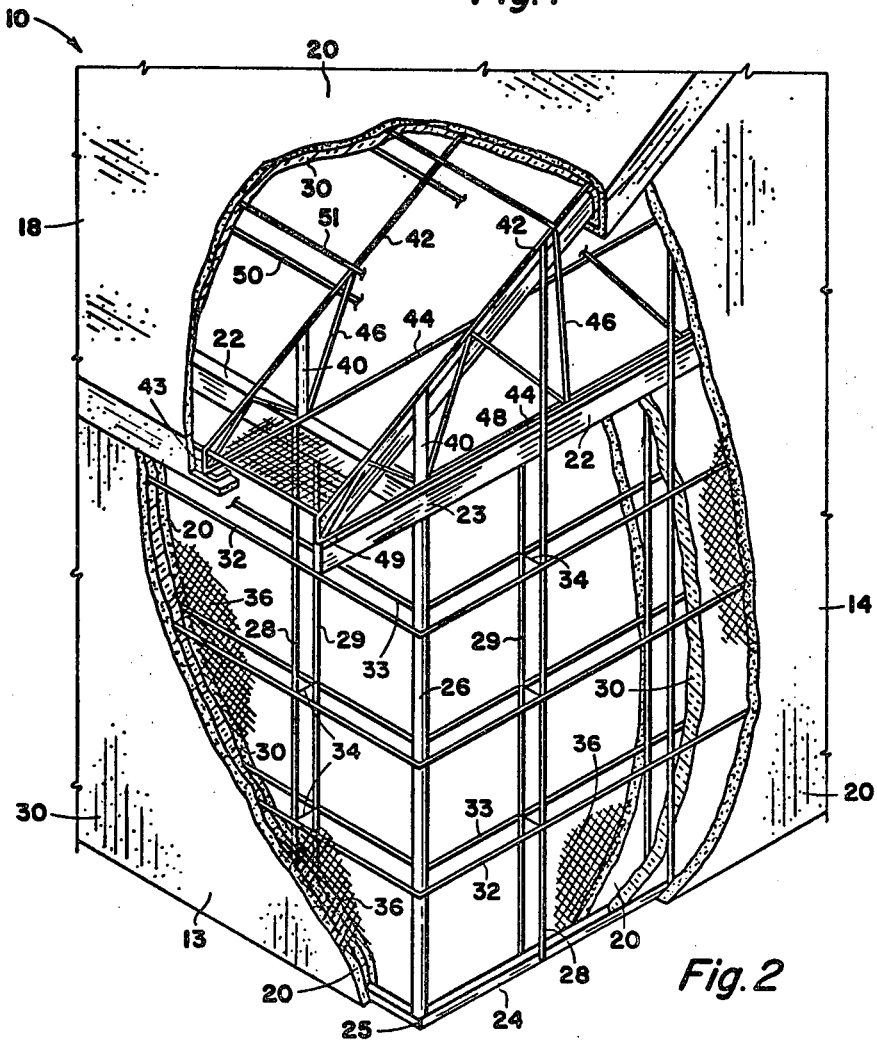
FIG. 2 is a perspective view of the remote rear corner of FIG. 1 with portions broken away to show the various layers of two wall sections forming a corner and the roof.

As shown in FIG. 2, the initial loose frame construction of the present invention comprises horizontally disposed upper hollow steel beams 22 and horizontally disposed lower steel channels 24 which are parallel to each other and run along the perimeter of building 10. Vertical steel corner posts 26 support beams 22 thereby disposing beams 22 above channels 24. Beams 22, channels 24 and posts 26 are light gauge steel, preferably 20 gauge.

The initial step of the frame construction is to arrange channels 24 in a closed polygon, in this example a rectangle, on a pre-set slab or base (not shown) and loosely anchored channels 24 to the slab by means of conventional anchor bolts (not shown).

Figure 4:
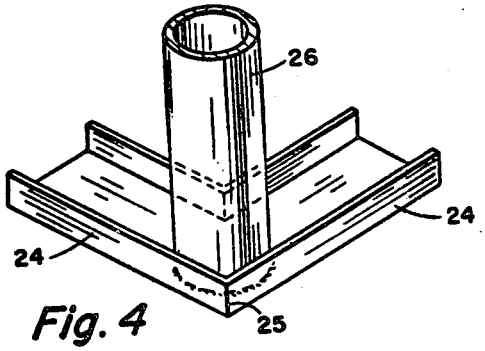
FIG. 4 is a perspective view showing a corner of the bottom and one end of a vertical corner post.
Figure 5:
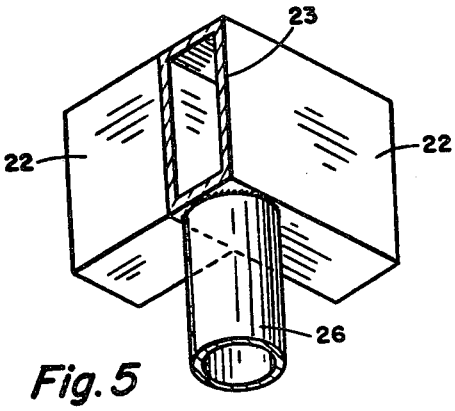
FIG. 5 is a perspective view showing a corner of the upper beam and the upper end of the corner post.
Figure 6:
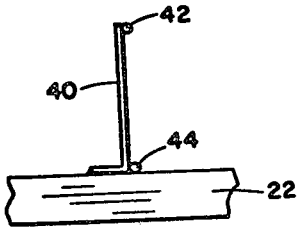
FIG. 6 is a perspective view of a roof bracket welded to the top of an upper beam.
Figure 3:
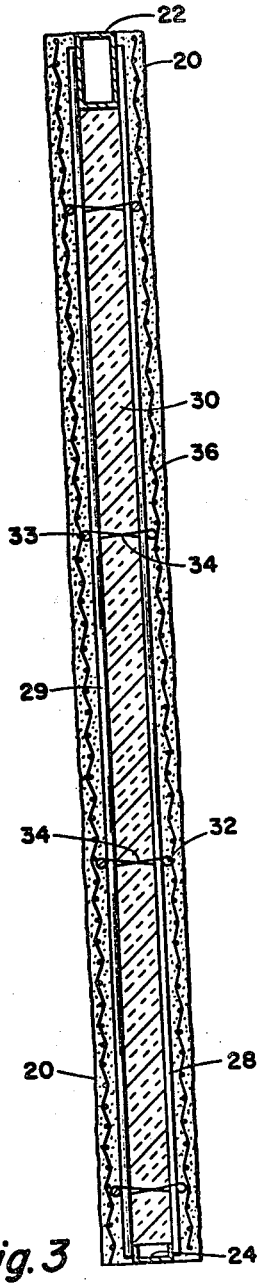
FIG. 3 is a cross-sectional view through one of the walls of the completed building.

As illustrated in FIGS. 4 and 5, channels 24 have mitered ends which are tack-welded together to form lower corners 25 of building 10. The lower ends of posts 26 are tack-welded to channels 24 at lower corners 25. The upper ends of posts 26 are tack-welded to upper corners 24 formed by the butted ends of beams 22 which have been tack-welded tgether. Upper corners 23 are vertically disposed directly above lower corners 25. However, the ends of beams 22 running along sides 11 and 13 extend beyond upper corners 23 to the lower edges of sloped sides 17 and 18 of roof 16.

Returning to a further consideration of FIG. 2, a first plurality of round vertical steel rods 28 are horizontally spaced 24" apart along the exterior of the frame. Rods 28 can be $\frac{1}{4}$" or $\frac{3}{8}$" round bars and are tack-welded to the exterior sides of beams 22 and channels 24. Along sides 12 and 14, the upper ends of rods 28 extend beyond beams 22, thereby becoming a part of the structure of roof 16 which will be described hereinafter.

After exterior rods 28 are affixed in place, a layer of 2 pound density pressed insulation 30 is disposed between beams 22 and channels 24. Insulation 30 is preferably 2'×8' sheets of a plastic insulation material such as polyurethane or tectum which have their lower edges placed within or on channels 24. Next, insulation 30 is loosely secured by a second plurality of interior vertical rods 29 which are the same size and materials as rods 28. The second plurality of rods 29 are placed along the same horizontal spacing as rods 28 and are tack-welded to the interior sides of beams 22 and channels 24. The upper ends of interior rods 29 terminate at the upper edges of beams 22.

An exterior and an interior plurality of horizontally disposed steel bars 32 and 33, respectively, of the same size and type as rods 28, are vertically spaced 24" apart. Bars 32 and 33 are secured to the frame at their points of intersection with rods 28 and 29 by tie wires 34. Tie wires 34 extend through insulation 30 and serve to pull bars 32 and 33 tightly against insulation 30 and rods 28 and 29.

Interior and exterior layers 36 of wire mesh are overlaid on bars 32 and 33, and are secured by tying the mesh to the bars by suitable means such as wires (not shown). Wire mesh 36 is of a type similar to fence material having open rectangular areas of 2"×4" or smaller and is preferably 16 gauge.

As shown in FIGS. 2 and 7, the construction of roof 16 is similar to the construction of walls 11, 12, 13 and 14. The frame of roof 16 comprises a plurality of steel brackets 40 tack-welded to the top of beams 22 along sides 11 and 13. Brackets 40 form the initial support for the trusss structures of a slanted or gable-type roof.

The trusses comprise a plurality of rods 42, of substantially the same size and materials as rods 28, tack-welded to the upper portions of brackets 40 and serve as top chords 42 of the trusses. Top chords 42 extend at an upwardly sloped angle from brackets 40, having their upper ends joined to a single horizontal rod or bar (not shown) of the same size and materials as rods 28 extending across the upper ends of top chords 42 to form apex line 19. The lower ends of top chords 42 are welded to the upper ends of a plurality of short vertical rods 43 along the edge of sloped sides 17 and 18 of roof 16.

A plurality of rods or bottom chords 44 are tack-welded to brackets 40 and upper beams 22, and are disposed horizontally along the same 24" spacings as vertical rods 28. Along vertical sides 11 and 13, bottom chords 44 extend to the lower edges of sloped sides 17 and 18 and are welded to the lower ends of short vertical rods 43.

Various web members 46, of varying lengths and inclinations, are tack-welded to top chords 42 and bottom chords 44 of the truss structure to provide additional support for roof 16. If desired, the components of the truss structures, top chords 42, bottom chords 44 and web members 46 may be pre-fabricated into individual roof trusses (not shown) in order to save construction site time.

A plurality of roof channels 48, of the same size and type as lower channels 24, are positioned on the outer edges of roof 16 along sides 12 and 14, and disposed in the same inclined planes as top chords 42. Roof channels 48 are secured to the frame of roof 16 by tack-welding their lower ends to the upper ends of a plurality of short vertical beams 49 and tack-welding their mitered upper ends to each other and apex line 19. The lower ends of short vertical beams 49 are tack-welded to the extended ends of upper beams 22.

The upper extending ends of exterior vertical rods 28 are tack-welded to the exterior of top chords 42 along sides 12 and 14. A layer of insulation 30 is disposed between apex line 19 and upper beams 22 after being cut to fit the triangular roof areas along sides 12 and 14. Tie wires 34 also extend through this insulation 30, securing it to exterior vertical rods 28.

An interior (lower) plurality of spaced horizontal roof bars 50 are tack-welded at their ends to the lower edges or roof channels 48. Roof bars 50 provide initial support for insulation 30. An exterior (upper) plurality of spaced horizontal roof bars 51 are then tack-welded at their ends to the upper edges of roof channels 48 thereby sandwiching insulation 30 between two rows or roof bars 50 and 51. Roof bars 50 and 51 are secured to insulation 30 by tie wires 34 in the same manner as horizontal bars 32 and 33.

Wire mesh 36 is then tied to bars 52, vertical rods 28 between apex line 19 and upper beams 22, and to the underneath side of the eaves.

At this point, the two frames of building 10 are complete and ready for exterior and interior layers of concrete 20. The frame is still loose and can be shifted somewhat from side to side. Before the application of the first coat of concrete 20, at least one corner post must be braced to a plumb or true vertical position. Concrete 20 is now applied either by gunning or by hand and is allowed to set for two hours while the corner bracing remains in place. Concrete 20 expands into all of the various gaps and spaces of the initial loose frame and as it sets, provides rigidity and load-bearing properties to building 10. After the two hours have elapsed, the bracing can be removed as building 10 is firm. At this point, a subsequent coat of concrete 20 can be applied; and afterwards, as many coats as desired or deemed necessary can be applied, allowing sufficient time for each layer to set. The concrete should reach a minimum strength of 4000 pounds p.s.i. strength in 28 days.

Whereas the present invention has been described in particular relation to the drawings attached thereto, it should be understood that other and further modifications, apart from those shown or suggested herein, may be made within the spirit and scope of this invention.

What is claimed is:

1. A method of constructing a building having load-bearing and insulation properties comprising the steps of erecting a loose frame by first arranging a plurality of horizontally disposed lower steel channels in the form of a closed polygon on a base support, said channels having ends welded together forming lower corners of said frame, mounting a plurality of vertical steel supporting posts on said lower corners and having their lower ends welded to said channels, arranging a plurality of horizontally disposed upper steel beams in the form of a matching closed polygon above said channels, said beams having ends welded together forming upper corners vertically disposed above said lower corners, said posts having their upper ends welded to said beams providing support for said beams so as to dispose said upper corners each above a lower corner whereby said upper polygon has a matching parallel relation to said lower polygon with said channels facing said beams, welding a first plurality of horizontally spaced vertical steel rods to the exterior side of said beams and channels, and having upper extending ends disposing a layer of plastic insulation material between said beams and said channels, welding a second plurality of horizontally spaced vertical steel rods to the interior sides of said beams and channels so as to sandwich said insulation material between said first and second plurality of vertical rods, arranging a first and a second plurality of vertically spaced horizontal steel bars on said first and second plurality of vertical rods and securing said bars to said frame by tying said bars to said rods at their points of intersection, arranging parallel layers of wire screen overlying said first and second plurality of horizontal bars and securing said layers to said frame by tying said layers to said bars thus completing said loose frame; arranging a bracing at one post so as to dispose the same in a plumb or true vertical position, then applying a layer of concrete to both sides of said frame and allowing a sufficient time lapse for said layer of concrete to set so as to provide said building with initial rigidity after which said bracing can be removed.

2. An assembly building construction method as set forth in claim 1 and further characterized by the steps of erecting a loose frame for a slanted type roof by first arranging a plurality of vertical steel brackets on the upper portion of said beams along a first pair of opposed sides of said building, welding a plurality of upwardly slanted rods or top chords on the upper portion of said brackets, welding the upper ends of said top chords to a rod forming an apex line of said roof, welding a plurality of horizontally disposed rods or bottom chords to the lower portions of said brackets, arranging a plurality of steel roof channels at roof edges perpendicular to said apex line, securing said roof channels to said roof frame by welding their lower ends to extensions of said beams on a second pair of opposed sides of said building, welding the upper ends of said roof channels together at said apex line, welding said upper extending ends of said first plurality of vertical rods positioned along said second pair of opposed sides to said top chords along the same side, disposing a layer of insulation between said apex line and said beams along said second pair of opposed sides, welding the ends of a first plurality of roof bars to the lower sides of said roof channels, disposing a layer of insulation on said first plurality of roof bars, welding the ends of a second plurality of roof bars to the upper sides of said roof channels so as to sandwich said insulation between said first and second plurality of roof bars, tying said first and second plurality of roof bars to said top chords, tying said upper extending ends of said vertical rods to said insulation along said second pair of opposed sides, overlaying a layer of wire mesh on said second plurality of roof bars and said upper extending ends of said vertical rods and tying said layer of wire mesh to the same, thus completing said roof frame.

3. An assembly building construction method as set forth in claim 2 and including applying a first layer of concrete to said roof frame simultaneous to the application of concrete to said building.

4. An assembly building construction method as set forth in claim 1 and including applying subsequent layers of concrete to said building.

* * * * *